United States Patent [19]

Monden et al.

[11] Patent Number: 4,629,587

[45] Date of Patent: Dec. 16, 1986

[54] SOLIDIFYING DISPOSAL SYSTEM FOR RADIOACTIVE WASTE

[75] Inventors: Keishi Monden; Ryozo Kikkawa; Susumu Horiuchi, all of Hitachi, Japan

[73] Assignee: Hitachi, Ltd., Tokyo, Japan

[21] Appl. No.: 536,444

[22] Filed: Sep. 28, 1983

[30] Foreign Application Priority Data

Sep. 29, 1982 [JP] Japan ..... 57-170171

[51] Int. Cl.[4] ..... G21F 9/16; G21F 5/00

[52] U.S. Cl. ..... 252/628; 250/506.1; 252/633; 422/903

[58] Field of Search ..... 250/506.1, 507.1; 252/628, 631, 633, 626, 629; 422/159, 903; 425/258; 264/0.5, 240, 333

[56] References Cited

U.S. PATENT DOCUMENTS

| | | | |
|---|---|---|---|
| 4,299,721 | 10/1981 | Hirano et al. | 252/628 |
| 4,299,722 | 10/1981 | Stock et al. | 252/628 |
| 4,341,915 | 7/1982 | Adachi et al. | 252/626 |
| 4,432,942 | 2/1984 | Adachi et al. | 250/506.1 X |

FOREIGN PATENT DOCUMENTS

| | | | |
|---|---|---|---|
| 3009314 | 10/1980 | Fed. Rep. of Germany | 252/626 |
| 2304995 | 10/1976 | France | 252/631 |
| 0155000 | 12/1977 | Japan | 252/633 |

*Primary Examiner*—Stephen J. Lechert, Jr.
*Assistant Examiner*—Howard J. Locker
*Attorney, Agent, or Firm*—Antonelli, Terry & Wands

[57] ABSTRACT

A system for disposing radioactive waste by solidifying the waste. The system has a lifting/lowering device for causing a relative vertical movement to bring a thin-walled container made of an inorganic material and a filling cap into contact with and away from each other. Supplying means are provided for supplying the container with the radioactive waste, solidifier and the post-filling solidifier, respectively, through the filling cap when the latter is held in contact with the container. The system further has a capping means for capping the container after filling with the radioactive waste and the solidifier. According to the invention, it is possible to conduct the essential steps such as the filling with the radioactive waste, filling with the solidifier, capping and the post-filling with minimal equipment and space.

7 Claims, 7 Drawing Figures

SOLIDIFYING DISPOSAL SYSTEM FOR RADIOACTIVE WASTE

BACKGROUND OF THE INVENTION

The present invention relates to a solidifying disposal system for radioactive waste and, more particularly, to a disposal system for charging and solidifying the radioactive waste in a thin-walled vessel of an inorganic material such as polymer-impregnated concrete (abbreviation PIC).

The specification of co-pending Japanese Patent Application No. 48651/1982 discloses a radioactive waste disposal method for charging and solidifying radioactive waste together with a solidifier in a thin-walled container of an inorganic material. This method consists of a process basically having the steps of charging the radioactive waste pellets into the container, charging the solidifier into the waste pellets in the container, closing a container cap, conducting a post-filling and sealing the container. The term "post-filling" is used here to mean a step in which the solidifier is further charged to the upper side of the container cap after the capping of the container thereby to seal and solidify the space on the container cap. According to this method, it is possible to obtain, by a suitable combination of the container and the solidified content, a solidified radioactive waste pack having superior properties such as strength, waterproofness, anti-swelling property and long-term weather resistance, and also to incrase the waste charging efficiency. The invention of the above-mentioned application, however, is not making any practical approach to a system for carrying out the above-described basic process.

For satisfactorily carrying out the basic process mentioned above, it is necessary to fulfill the following requirements.

(1) To maintain the accuracy of measurement of the waste pellets to be charged in the vessel.

(2) To maintain the permeability of the solidifier into the voids among the waste pellets charged in the container.

(3) To adequately and efficiently conduct the charging of the solidifier into the container, as well as the post-filling.

(4) To adequately and effectively cap the container after charging of the waste and solidifier into the container.

(5) To realize the solidifying disposal in accordance with the basic process with minimal equipment and minimal installation space.

(6) To prevent the diffusion of the radioactive dusts into atmosphere during charging of the radioactive waste.

SUMMARY OF THE INVENTION

Accordingly, an object of the invention is to provide a practical system for conducting solidifying disposal of radioactive waste using a thin-walled container made of an inorganic material, capable of executing with minimal equipment and minimal space the basic process consisting of charging of the radioactive waste, charging of the solidifier, capping of container and post-filling, well satisfying the above-mentioned requirements.

To this end, according to the invention, there is provided a radioactive waste disposal system for filling a thin-walled container of an inorganic material with the radioactive waste and solidifying the waste by a solidifier, the system comprising: a table for mounting the container; a filling cap disposed just above the table; a relative lifting/lowering device for causing a relative movement between the table and the filling cap until the lower peripheral edge of th filling cap is contacted by the upper peripheral edge of the container; respective supplying means for supplying the radioactive waste and the solidifier in such a manner that the filling of the container with the radioactive waste, pouring of the solidifier into the container and the pouring of the solidifier for post-filing after a capping of the container are made through the filling cap when the latter is held in contact with the container; and a capping means adapted for capping the container on the table with a cap made of an inorganic material when the filling cap is spaced from the container after filling with the radioactive waste and the solidifier. According to the invention, it is possible to carry out the above-described basic process with the container set in one planar position, without any necessity to move the container in horizontal plane.

Other objects, features and advantages of the invention will become clear from the following description of the preferred embodiments taken in conjunction with the accompanying drawings.

DESCRIPTION OF THE PREFERRED EMBODIMENTS

Figure 1:
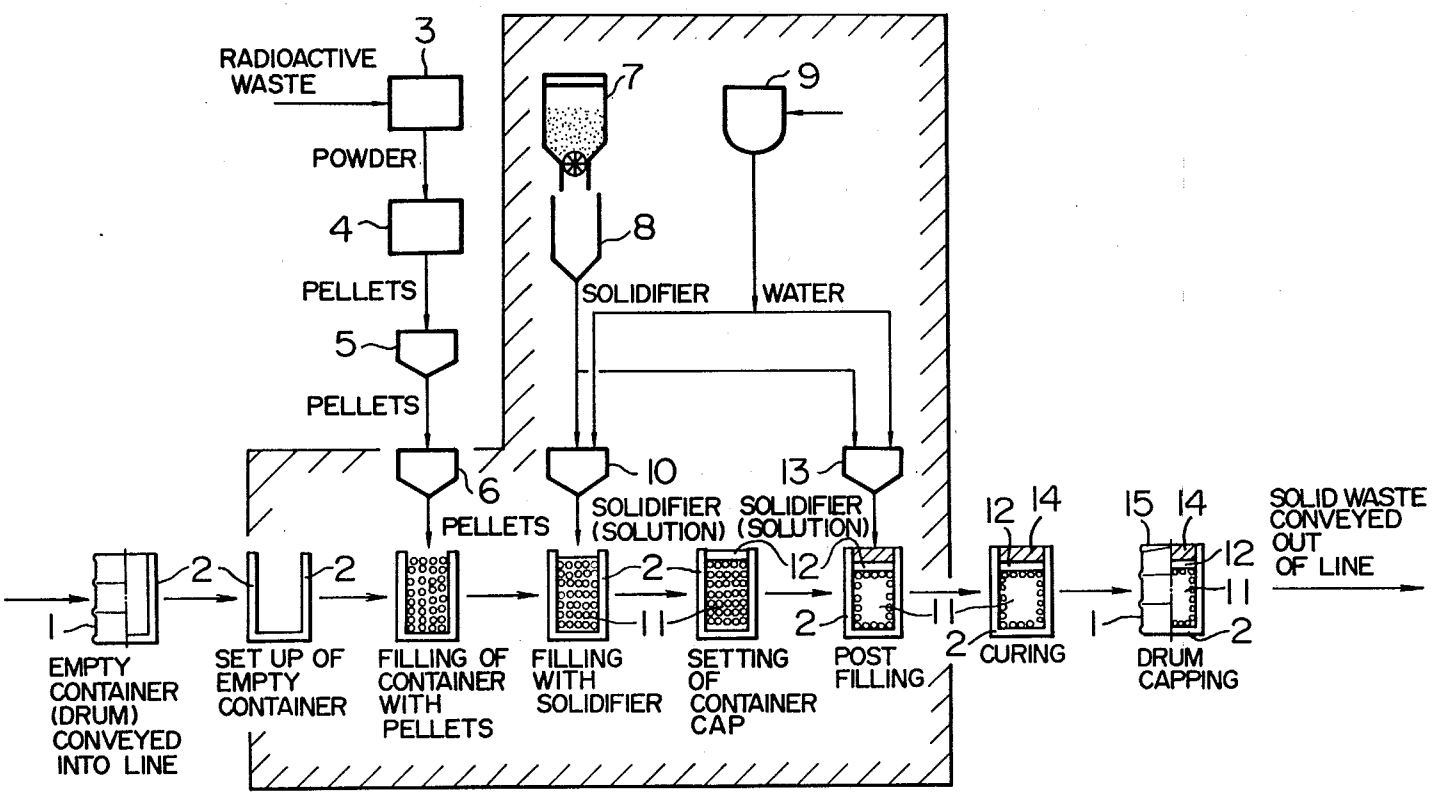
FIG. 1 is a basic system flow chart of a solidifying disposal system for radioactive waste embodying the present invention.

Preferred embodiments of the solidifying disposal system for radioactive waste in accordance with the invention will be described hereinunder with reference to the accompanying drawings.

A first embodiment of the invention is a so-called pellet solidification type system in which the radioactive waste is pelletized and solidified by a solidifier. In this embodiment, a special inorganic waterproof water glass is used as the solidifier. This, however, is not exclusive and the invention can be carried out in the form of a homogeneous solidification system in which radioactive waste is powdered and solidified through kneading together with a solidifier, as will be explained later. It is also to be noted that other solidifier than the special water glass mentioned above can be used satisfactorily.

The concept of the basic system flow in the solidifying radioactive waste disposal system of the invention will be explained with reference to FIG. 1. It is to be understood, however, that this Figure is only to illustrate the steps of the disposal process but is not intended for showing the spatial arrangement of the constituents or stations employed by the process.

First of all, an empty container which is a thin-walled container 2 made of an inorganic material such as PIC, enclosed by a drum canister 1, is conveyed into the solidifying disposal line and is set up in the latter. Then, the container 2 is filled with pelletized radioactive waste. The pelletized radioactive waste is prepared through drying and pulverizing step 3 and pelletizing step 4 and is charged into the container 2 through a measuring hopper 6 after a temporary storage in a storage vessel 5. The amount of charge of the pelletized radioactive waste into the container 2 is measured by the apparent volume thereof, by means of the measuring hopper 6. For the clarification of the drawings, the drum canister 1 is illustrated only in a part of the process in FIG. 1.

Subsequently, a solidifier consisting of a special water glass is charged into a container 2 filled with the pelletized radioactive waste. More specifically, the powdered material of the solidifier is transported from a solidifier tank 7 to a solidifier measuring tank 8 and a predetermined amount of the solidifier measured by the measuring tank 8 conveyed to a solidifier kneading tank 10. On the other hand, the amount of water to be added to the solidifier is calculated on the basis of a predetermined ratio of mixing with the powdered solidifier, and this amount of water is accurately measured by means of a water measuring tank 9. The measured water is then delivered to a solidifier kneading tank 10 in which the powdered solidifier is kneaded sufficiently together with the water by a kneader. Then, a predetermined amount of the kneaded solidifier is poured into the container 2 from the kneading tank 10.

Then, a container cap 12 made from an inorganic material is set on the filler 11 consisting of the waste pellets and the solidifier filling the container. Subsequently, a post-filling with the solidifier in the liquid state is conducted on the container closed by the cap. In the illustrated example, the solidifier of liquid state is poured from a tank 13. A reference numeral 14 denotes a solidifier layer formed by this post-filling. Subsequently, the content of the container is cured for a predetermined time suitable for the hardening of the solidifier. Then, the cap 15 of the drum canister is fitted to complete the solidified radioactive waste pack which in turn is transported to a storage station wherein a plurality of packs are stored temporarily.

The concept of the basic flow of the solidifying radioactive waste disposal system of the first embodiment, employing thin-walled container of inorganic material filled with pelletized radioactive waste, has been described with specific reference to FIG. 1. More strictly, the invention is concerned with the portion of the process within the hatched area in FIG. 1, i.e. the portion of the process including the steps of setting up of the container, filling with the radioactive waste, filling with the solidifier, capping of the container and the post-filling.

The detail of this embodiment will be described hereinunder with reference to FIG. 2 which schematically shows a system of the first embodiment and also to FIGS. 3, 4, 5 and 6 which are illustrations of respective parts of the system shown in FIG. 2. For the simplification of the drawings, the drum canister 1 appears only in a part of this series of Figures.

Figure 2:
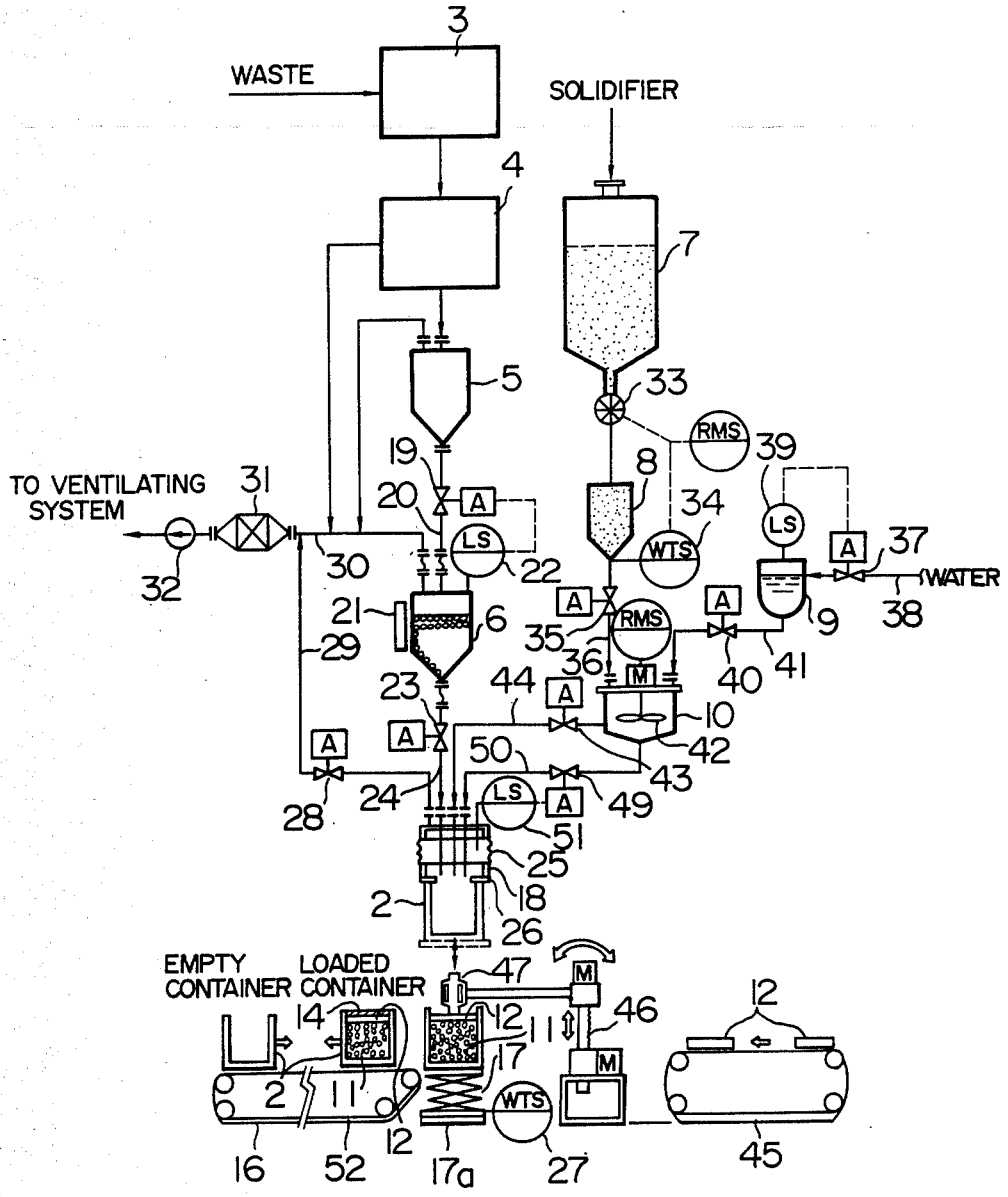
FIG. 2 is a schematic illustration of the solidifying disposal system for radioactive waste in accordance with the invention.

Referring to FIG. 2, an empty container is transported to the filling position by means of an empty container conveyor 16, and is placed on a table of a lifting/lowering device 17. The lifting/lowering device 17 operates along a guide rod 53 (see FIG. 3) until the empty container 2 is brought into contact with a filling cap 18 as illustrated.

On the other hand, a valve 19 of the pellet storage tank 5 is opened so that the pellets of the radioactive waste is introduced into the pellet measuring hopper 6 through a pipe 20. The measuring hopper 6 is vibrated by a hopper vibrator 21 so that the stack of pellets in the hopper 6 is levelled and flattened. As a predetermined level of the stack of pellets is reached, the level switch 22 is activated to automatically close the valve 19 thereby to complete the measuring of the pellet by volume. Then, a valve 23 is opened so that the measured amount of pellets is charged into the container through a pipe 24 which leads to the filling cap 18.

This filling operation will be described in more detail. A large variety of kinds of radioactive waste are treated by the pellet solidifying disposal system. These wastes are, for example, enriched waste liquid, spent particulate resin, spent powdered resin, sludge and so forth. In addition, various components are included by the radioactive waste, taking into account also the disposal of the mixture wastes. In consequence, the nature, mainly the specific weight, exhibited by the pellets after the drying and pelletizing varies widely. On the other hand, the batch amount of the radioactive waste to be charged into the container is limited by the internal volume of the container 2. The amount of the pelletized radioactive waste, therefore, should be controlled on the basis of volume. From this point of view, in the described embodiment of the invention, the measuring of the pellets is made on the basis of apparent volume by means of the measuring hopper 6. The pellets naturally dropped onto the hopper, however, may cause an unlevel surface of the stack of pellets within the region of resting angle to impair the accuracy of the measurement. In this embodiment, in order to attain a high accuracy of the measurement, the hopper 6 is vibrated by the vibrator 21 during the receiving of the pellets while measuring the pellet level. Then, after a predetermined level is reached, i.e. after the receipt of the predetermined amount of pellets, a pellet receipt completion signal is issued to stop the receipt of the pellets thereby to maintain the accuracy of measurement of the predetermined amount of pellets. The measurement of the level of the pellets may be made by means of an electric capacitance type level meter.

After the filling of the container 2 with the pellets, the container 2 is vibrated by a container vibrator **17*a* attached to the lifting/lowering device 17 thereby to flatten the level of the stack of pellets in the container 2. If the container 2 is let alone without vibration after the filling with the pellets, the surface of the stack of pellets will remain unlevel to cause various problems such as an uneven distribution of the solidifier or insufficient permeation of the same to some portions of the stack of pellets in the container, in the subsequent steps, i.e. filling with solidifier, capping of container and post-filling. To avoid these problems, according to the invention, the container 2 is vibrated after the receipt of the pellets. The vibration of the container is effected by the vibrator 17*a* which vibrates the table on which the container 2** is mounted.

In order to prevent any diffusion or scattering of the radioactive dusts during the filling of the container with the pellets, the upper brim of the container 2 is pressed against a packing 26 attached to the fillng cap 18 while measuring the contact pressure thereby to maintain a sufficiently tight seal. In order to absorb the vibration, the filling cap 18 is provided with bellows 25. Simultaneously with the opening of the valve 23, a vent valve 28 is opened automatically so that the atmosphere in the container 2 is sucked through a pipe 29, pipe 30 and a filter 31 by means of a blower 32 of the vent-disposal line of equipments for handling the waste powder and pellet in the solidifying disposal system. In consequence, the atmosphere in the container 2 is maintined slightly below the atmospheric pressure to prevent the diffusion or scattering of the radioactive dusts and to dispose such radioactive dusts.

Meanwhile, the material of the solidifier, which is in this case a special inorganic water glass and, hence, the material thereof is prepared in the form of powder, is fed from a solidifier tank 7 into a solidifier measuring tank 8 by means of a rotary feeder 33. The amount of the solidifier material received by the tank 8 is measured by a load cell 34. Namely, when a predetermined weight of the solidifier material is received by the tank 8, the load cell 34 produces a signal for stopping the rotary feeder 33, thereby to cease the feed of the solidifier material, thus completing the measurement of the solidifier material.

On the other hand, the water to be added to the solidifier is supplied from a pouring system to a water measuring tank 9 through a pipe 38 as a valve 37 in the latter is opened. The amount of water received by the water measuring tank 9 is controlled by means of a level switch 39 and, when a predetermined amount of water is received, the valve 37 is automatically closed to stop the pouring of the water, thus completing the measurement of the water. The material powder of the solidifier and the water thus measured are then introduced into a kneading tank 10 through pipes 36 and 41 as the valves 35 and 40 are opened, and are kneaded together by a kneader 42. After the kneading, the solidifier is poured into the container 2 filled with the pellets, through a pipe 44 as a pouring valve 43 is opened. The pipe 44 opens to an intermedite portion of the tank 10 above the bottom of the latter, so that only a predetermined amount of solidifer is supplied into the container 2. More specifically, the amount of pouring of the solidifier is so adjusted that the level of the thus supplied solidifier is slightly above the level of the flattened stack of the pellets in the container 2, taking into account the permeability of the pellet solidifier.

To explain in more detail in this connection, the solidifier is supplied in two times in the pellet solidifying disposal system of the invention: namely after the filling of the container with the waste pellets and after the capping of the container.

The amount of the first pouring, i.e. the pouring to the container after filling with the pellets, has to be controlled strictly. Namely, any shortage of the solidifier may cause an imperfect solidification of the radioactive waste pack due to insufficient permeation of the solidifier into the voids in the stack of the pellets. To the contrary, any surplus solidifier may cause an attaching of the solidifier to the capping machine or, in the worst case, an overlfow to cause a serious problem of radioactive contamination.

In the described embodiment, therefore, the following measure is taken to effect a strict control of the amount of the first pouring of the solidifier. Two pipes are conencted to the kneading tank 10: namely, a pipe 44 for the first pouring connected to a heightwise intermediate portion of the kneading tank 10 and a pipe 50 for the second pouring, i.e. the post-filling, connected to the bottom of the kneading tank 10. Thus, the amount of the kneaded solidifier corresponding to the difference of level between the openings of these two pipes is preserved in the kneading tank 10 after the first pouring. The preserved kneaded solidifier is used for the post-filling. By so doing, it is possible to maintain the accuracy of control of the amounts of the first pouring and the second pouring of the kneaded solidifier. It will be understood also that this arrangement advantageously permits the measuring the kneading of the total amount of solidifier including those for the first pouring and second pouring in one time.

Figure 3:
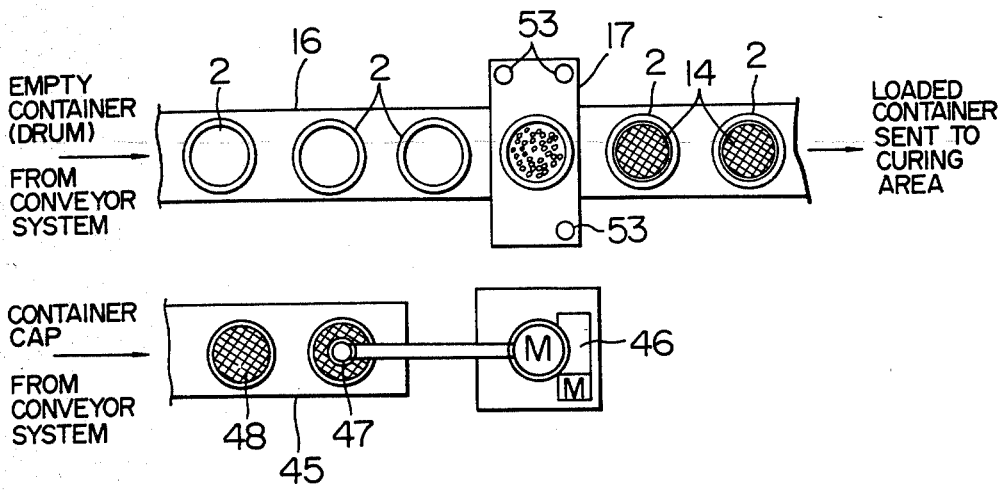
FIG. 3 is a schematic plan view of a container capping means incorporated in the embodiment shown in FIG. 2.
Figure 4:
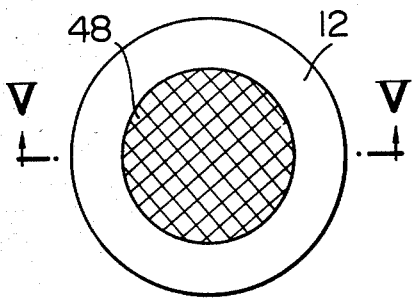
FIG. 4 is a plan view of a container cap made of an inorganic material suitable for use in the embodiment.
Figure 5:
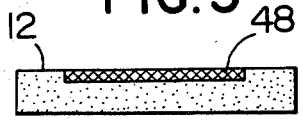
FIG. 5 is a sectional view taken along the line V—V of FIG. 4.

After being filled with the pellets and the solidifier, the container 2 is lowered to the lowermost position by the operation of the lifting/lowering device 17 and then the cap 12 of the container is set up for the capping of the container. The cap 12 is conveyed by a cap transferring conveyor 45 to the area in the vicinity of a capping device 46. More specifically, the capping device 46 has a solenoid 47 attached to the end of a rotary arm thereof. The solenoid 47 attracts and holds an iron plate 48 embedded in the upper surface of the cap 12 as shown in detail in FIGS. 4 and 5. The cap 12 electromagnetically held by the capping device 46 and conveyed by the same to the position of the loaded container 2 and is set by being lightly pressed onto the surface of the filler 11 consisting of the waste pellets and the solidifier. Thereafter, the solenoid 47 is deenergized and the rotary arm is moved out of the path of the lifting/lowering device 17. Since FIG. 2 cannot show the planar arrangement of the construction for setting the container cap 12, another drawing, i.e. FIG. 3 is illustrated to show the plan view of this arrangement. From FIG. 3, it will be understood that the mechanism for setting the container cap 12 is designed and constructed to minimize the occupation of the space and to permit a smooth movement of the parts concerned.

The container cap 12 has a certain minimum thickness which is determined from the view point of security of physical properties as a solid structural member and, particularly when PIC is used as the material, also from the view point of the manufacture. In order to obtain a high waste charging efficiency, the container cap 12 is preferably made flat and has a thickness approximating the minimum thickness, and it is not preferred to provide any eye, projection or the like on the container cap 12 for the purpose of transportation of the cap 12 by a hook or the like. In the described embodiment, therefore, the container cap 12 is made in a substantially circular form from an inorganic material such as PIC with the iron plate 48 embedded in the upper surface thereof, and the transportation of the container cap 12 is made by means of the capping device 46 which has a solenoid for attracting and holding the cap 12 electromagnetically as explained before. The diameter of the container cap 12 is selected to be somewhat smaller than the inside diameter of the container 2. The cap 12 is set such that it sinks slightly below the upper end of the container to form a recess which is to be filled later with the solidifier by the post-filling.

Referring again to FIG. 2, the capped container 2 is lifted again by the lifting/lowering device 17 for the purpose of the post-filling, until it contacts the filling cap 18. Thereafter, all of the remaining of the kneaded solidifier preserved in the kneading tank 10 for the post-filling is discharged and poured into the recess on the cap 12 in the container 2 through the pipe 50 leading from the bottom of the tank 10, as the valve 49 is opened. In order to prevent any overflow of the container, the filling cap 18 is provided with a protecting circuit having a level switch 51 which is adapted to produce, when the top recess in the container is filled completely, a signal for closing the valve 49 automatically.

The container 2 after the post-filling conducted in the described manner is conveyed to a drum curing area by means of the loaded-container transferring conveyor.

The basic arrangement and operation of the solidifying radioactive waste disposal system of this embodiment have been described.

Figure 6:
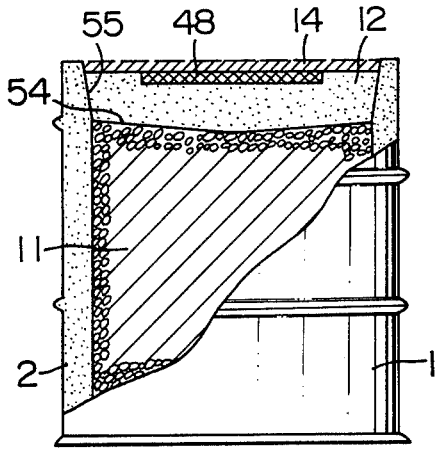
FIG. 6 is a sectional view of a container and a cap which are made of an inorganic material and suited for use in the present invention.

FIG. 6 shows examples of the shapes of the container 2 and the container cap 12 suitable for attaining a good fit between the cap 12 and the container 2 and a good affinity between the cap 12 and the solidifier in the filler 11, as well as the hardened post-filling solidifier, while minimizing the formation of voids in the filler of the container. Namely, in the example shown in FIG. 6, the container cap 12 is provided on the lower surface thereof with a conical surface 54 for relieving the air, thereby to prevent the generation of voids within the container. In addition, the inner surface of the brim of the container 2 is tapered to cooperate with a tapered outer peripheral surface 55 of the cap 12 to allow the relief of air and to attain a close fit between the cap and the container wall.

Figure 7:
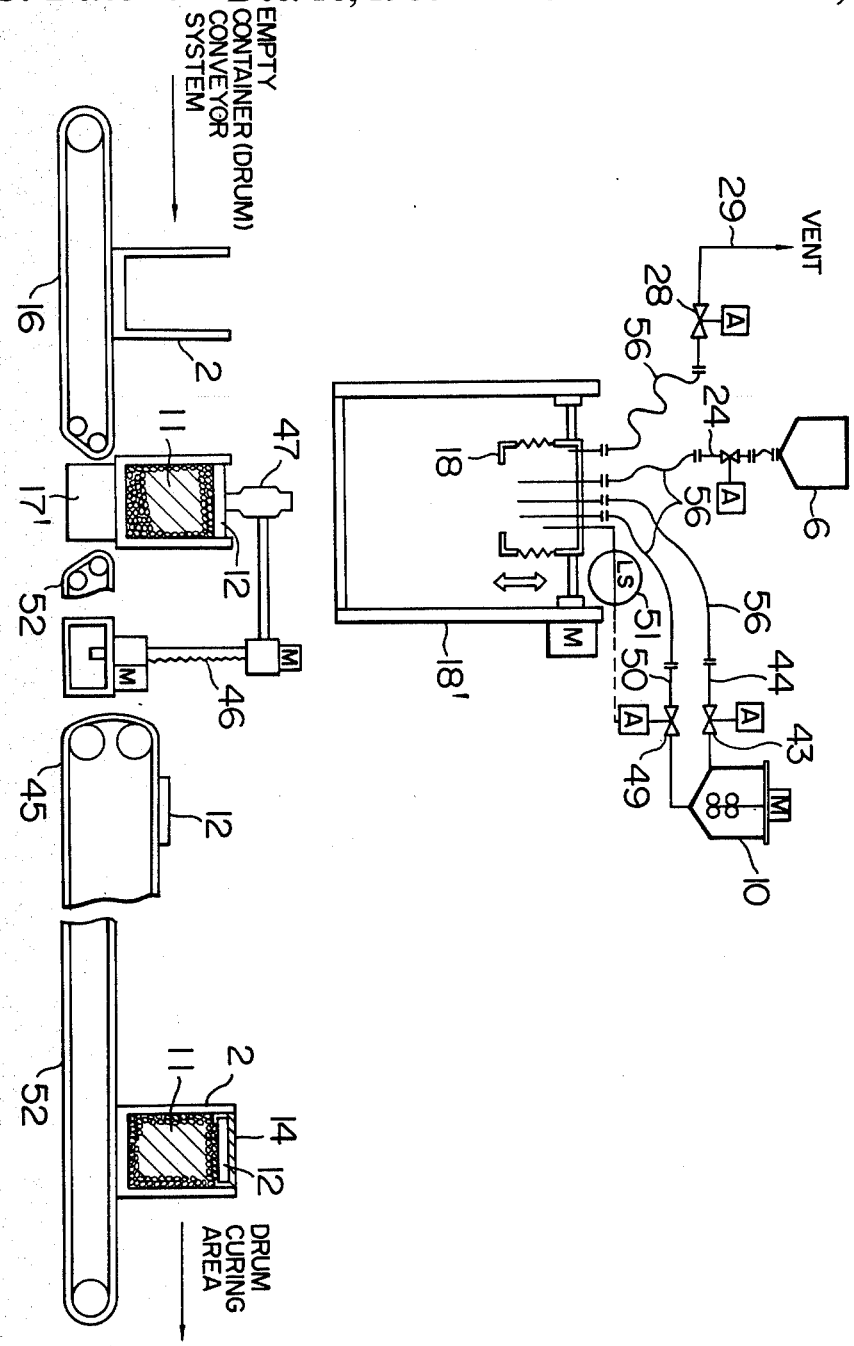
FIG. 7 is a schematic illustration of another embodiment.

FIG. 7 shows another embodiment of the invention which differs from the embodiment shown in FIG. 2 in that a cap lifting/lowering device 18′ is used in place of the container lifting/lowering device 17 in the described embodiment. Namely, in this case, the container 2 is placed on a stationary table 17′ provided with a vibrator, and the setting of the filling cap 18 is made by means of the cap lifting/lowering device 18 which is adapted to lower the filler cap 18 to press the same onto the container. In this embodiment, therefore, the pipes connected to the filling cap 18 are substituted by flexible hoses 56.

The solidifying disposal system of the invention for disposing radioactive waste offers the following advantages.

(1) Successive steps of the process, e.g. filling of the container with the waste, filling of the container with the solidifier, capping of the container and the post-filling are made in one planar position without requiring any movement of the container in the horizontal plane, although a vertical movement of the container or, alternatively, of the filling head is necessary. This arrangement considerably improves the space factor of the whole system. Furthermore, a single filling cap can be used commonly for three kinds of operation: namely, the filling with the waste pellets, filling with the solidifier and the post-filling. At the same time, the single system for the supply and pouring of the solidifier can be used for both of the first pouring, i.e. pouring into the container, and the second pouring, i.e. the post-filling. By this rational use of the devices, it is possible to simplify the system as a whole and to minimize the number of required devices or parts. Thus, the system of the invention is quite superior in both aspects of efficiency and economy.

(2) By imparting a vibration during measuring of the pellets and after filling of the container with pellets, it is possible to attain a high accuracy of the measurement and a uniform permeation of the solidifier into the stack of pellets filling the container.

(3) The amounts of the first pouring of the solidifier, i.e. the pouring into the container, and the amount of the second pouring of the same, i.e. the post-filling, can be controlled highly accurately by the selective use of two pipes, i.e. the pipe leading from the intermediate portion of the kneading tank and the pipe leading from the bottom of the same tank. This arrangement makes it possible also to measure and knead the total amount of the solidifier, i.e. the sum of the amount for the pouring into the container and the amount for the post-filling, at one time. In consequence, the system as a whole is simplified, and the economy and the efficiency are increased, thanks to the common use of this equipments.

(4) The handling of the container cap is made electromagnetically by the cooperation between the iron plate embedded in the cap and the solenoid of the capping device. This advantageously permits the minimization of the cap thickness, which in turn affords a further improvement in the charging efficiency.

(5) The undesirable diffusion or scattering of the radioactive dusts during filling with radioactive waste is avoided.

Although a pellet solidifying disposal system in which the radioactive waste in the form of pellets are solidified by a solidifier consisting of inorganic special water glass has been described as a preferred embodiment, this embodiment is not exclusive and can be modified and changed in various ways. For example, the same advantages are brought about when a plastic solidifier or asphalt is used in place of the special water glass as the solidifier in combination with the pelletized radioactive waste.

It is also possible to carry out the invention in the form of a homogeneous solidification disposal system, instead of the pellet solidification disposal system described hereinbefore. Namely, the successive steps of operation in the described embodiment, i.e. the filling with radioactive waste, filling with the solidifier, capping of the container and the post filling, can be applied substantially directly to the homogeneous solidifying disposal system, although a minor change will be required in the whole process.

What is claimed is:

1. A radioactive waste disposal system for filling a thin-walled container of an inorganic material with radioactive waste and solidifying said waste by a solidifier, said system comprising: a table for mounting said container; a filling cap disposed just above said table; lifting/lowering means for causing a relative movement between said table and said filling cap until the lower peripheral edge of said filling cap is contacted by the upper peripheral edge of said container; supplying means for supplying said radioactive waste and said solidifier to said filling cap such that, when the filling cap is held in contact with said container, said container is filled with said radioactive waste, said solidifier is than poured into said container and thereafter said solidifier is poured for post-filling after and above a capping of said container; and a capping means for capping said container on said table with a cap made of an inorganic material when said filling cap is spaced from said container after filling said container with said radioactive waste and said solidifier.

2. A radioactive waste disposal system according to claim 1, wherein said radioactive waste is pelletized, and said supplying means for supplying said radioactive waste to said filling cap includes a measuring hopper adapted to measure the amount of said pellets to be supplied to said container from the volume of the pellets received by said hopper; said system further comprising a vibration means adapted to impart a vibration to said measuring hopper when said hopper is receiving said pellets.

3. A radioactive waste disposal system according to either one of claims 1 and 2, wherein said means for supplying said solidifier to said filling cap includes a solidifier measuring tank and kneading tank, a solidifier pouring pipe leading from a heightwise intermediate portion of said kneading tank to said filling cap, and a post-filling conduit leading from the bottom of said kneading tank to said filling cap.

4. A radioactive waste disposal system according to any one of claims 1 and 2, wherein said cap made of an inorganic material has a magnetic plate embedded in the upper surface thereof, and said capping device has an arm provided with a solenoid for magnetically attracting said cap and adapted to convey said cap to a capping position.

5. A radioactive waste disposal system according to either of claims 1 and 2, further comprising a vibration means for imparting vibration to said container after filling with said radioactive waste in advance of the pouring of said solidifier.

6. A radioactive waste disposal system according to either of claim 1 and 2, further comprising a diffusion prevention means for preventing diffusion of radioactive dusts, said diffusion prevention means including a sealing means provided on said filling cap to form a tight seal between said container and said filling cap when said container and said cap are held in tight contact with each other, and a means for sucking the atmosphere into said container through said filling cap.

7. A radioactive waste disposal system according to claim 1, wherein said container is made of a thin-walled, nonmetallic material.

* * * * *